United States Patent [19]

Findlay

[11] Patent Number: 4,553,024

[45] Date of Patent: Nov. 12, 1985

[54] GAS-PURGED FLEXIBLE CABLE-TYPE IMMERSION HEATER AND METHOD FOR HEATING HIGHLY CORROSIVE LIQUIDS

[75] Inventor: Gordon R. Findlay, Northfield, Ohio

[73] Assignee: Lufran, Inc., Macedonia, Ohio

[21] Appl. No.: 482,909

[22] Filed: Apr. 7, 1983

[51] Int. Cl.[4] ..... H05B 1/02; H05B 3/78; F24H 1/20

[52] U.S. Cl. ..... 219/335; 219/306; 219/316; 219/331; 219/523; 219/544; 219/549; 338/214; 338/234

[58] Field of Search ..... 219/306, 316, 318, 335, 219/336, 523, 528, 538, 544, 319, 331, 328, 549; 338/234–237, 214, 212

[56] References Cited

U.S. PATENT DOCUMENTS

| | | | |
|---|---|---|---|
| 4,158,764 | 6/1979 | Yane | 219/523 X |
| 4,179,603 | 12/1979 | Zeigler et al. | 219/523 X |
| 4,390,776 | 6/1983 | Yane et al. | 219/523 |

FOREIGN PATENT DOCUMENTS

| | | | |
|---|---|---|---|
| 660364 | 4/1963 | Canada | 338/237 |

*Primary Examiner*—A. Bartis

*Attorney, Agent, or Firm*—R. A. Johnston; C. B. Fagan

[57] ABSTRACT

An electric immersion heating apparatus for heating highly corrosive liquids includes a flexible cable-type immersion heater having a continuous coiled resistance heating element disposed in axially spaced pitches and being enclosed in a continuous tubular outer jacket formed of a flexible plastic material, such as polytetrafluoroethylene with a PFA side chain, resistant to chemical attach by highly corrosive liquids. The outer jacket is received over the coiled heating element in closely fitting relationship and has a wall thickness sufficiently thin to provide efficient heat transfer from the coiled element to the liquid being heated. Because of its thinness the outer tubular jacket is subject to permeation of damaging corrosive vapors through the jacket to the coiled heating element. During use the heater is immersed in the corrosive liquid except for its ends and a continuous flow of pressurized dry gaseous medium is circulated through the jacket in surrounding relation to the coiled element from one end of the heater to the other for continuously scavenging any corrosive vapors which may have permeated through the outer jacket into the interior of the heater.

2 Claims, 3 Drawing Figures

GAS-PURGED FLEXIBLE CABLE-TYPE IMMERSION HEATER AND METHOD FOR HEATING HIGHLY CORROSIVE LIQUIDS

BACKGROUND OF THE INVENTION

The present invention relates to immersion heaters for heating liquid in a bath and, particularly, to electrical resistance heaters formed of a continuous, flexible cable. Flexible cable resistance heaters are particularly suitable for immersion in corrosive chemical baths since the exterior of the flexible cable may be jacketed with a suitable plastic material having satisfactory resistance to the corrosive nature of the chemical bath being heated. An example of a flexible cable resistance heater is that shown and described in U.S. Pat. No. 4,158,764 issued to Frank J. Yane and assigned to the assignee of the present invention.

It is known to provide such flexible cable heaters with an outer casing or jacket formed of polytetrafluoroethylene (PTFE) material which, although has satisfactory resistance to chemical attack by corrosive liquid media, has the disadvantage that when employed in a thin wall for the desired flexibility, the permeability of the PTFE material has been found to permit transmigration of heated chemical vapor into the interior of the cable heater. It has been found in service that the accumulation of corrosive chemical vapor within the heater cable corrosively attacks the material of the coil heating element and causes early deterioration of the heating element and consequent failure of the cable heater.

Thus, it has long been desired to find a way for means of protecting a plastic jacketed, flexible cable immersion heater from the effects of accumulated permeation of hot chemical vapors into the interior of the cable heater and, yet, retain the flexibility and desirable heat transfer properties of the thin wall plastic jacket for the cable heater. It has further been desired to find a technique for preventing corrosive attack on the resistive heating element in a flexible cable heater without increasing the thickness or decreasing the heat transfer capabilities of the outer jacket of the cable heater.

SUMMARY OF THE INVENTION

The present invention provides an improvement in flexible cable resistance heaters and, particularly, provides an improvement over the flexible cable heater shown and described in U.S. Pat. No. 4,158,764 referenced hereinabove.

The present invention provides a flexible cable heater immersion heater having a resistive wire heating element formed in axially spaced coiled pitches, and having a sheath of braided glass fibrous material received thereof in closed spaced sliding arrangement.

The present invention employs an outer jacket of chemically resistive plastic material received over the braided sheath in closely spaced presliding arrangement. The outer jacket of the present immersion heater comprises a thin wall plastic tube which provides the desired heat transfer and yields the requisite flexibility to permit the cable heater to be formed in an array comprising a plurality of excursions or windings.

The cable heater of the present invention has the outer jacket thereof connected to a suitable source of dry gaseous medium for circulation from one end of the heater cable through the interior of the heater cable and over the heating element to exhaust at the opposite end of the heater cable. The present invention, thus, provides a continuous dry gas flow or purge over the resistance heating element to scavenge any accumulated corrosive chemical vapors which may have permeated through the outer plastic jacket of the heater cable.

The immersion heater cable assembly of the present invention employs a unique arrangement of a thermocouple disposed interiorly of the heater cable intermediate the ends thereof for sensing any overheating of the heater cable. The novel thermocouple arrangement of the present cable heater employs a junction thermocouple encased in a thermosetting plastic and disposed intermediate the braided sheath and the outer plastic or casing of the heater cable. The unique thermocouple arrangement of the present heater cable provides a high degree of sensitivity to sudden overheating of the jacket and is connected to a temperature controller for immediately disconnecting power from the heater in the event of such heating of the cable jacket.

The present invention, thus, provides a unique immersion heater formed of a flexible cable having dry gas purged over the full length of the heating element for removing accumulation of corrosive chemical vapor which may have permeated the outer casing of the heater cable. The present invention also provides a novel arrangement of a thermocouple embedded in a thermosetting plastic casing and disposed between the braided glass fiber sheath and the outer jacket of the cable heater to provide a self-contained thermocouple sensor for overheating of the cable due to loss of liquid in the bath.

DETAILED DESCRIPTION

Figure 1:
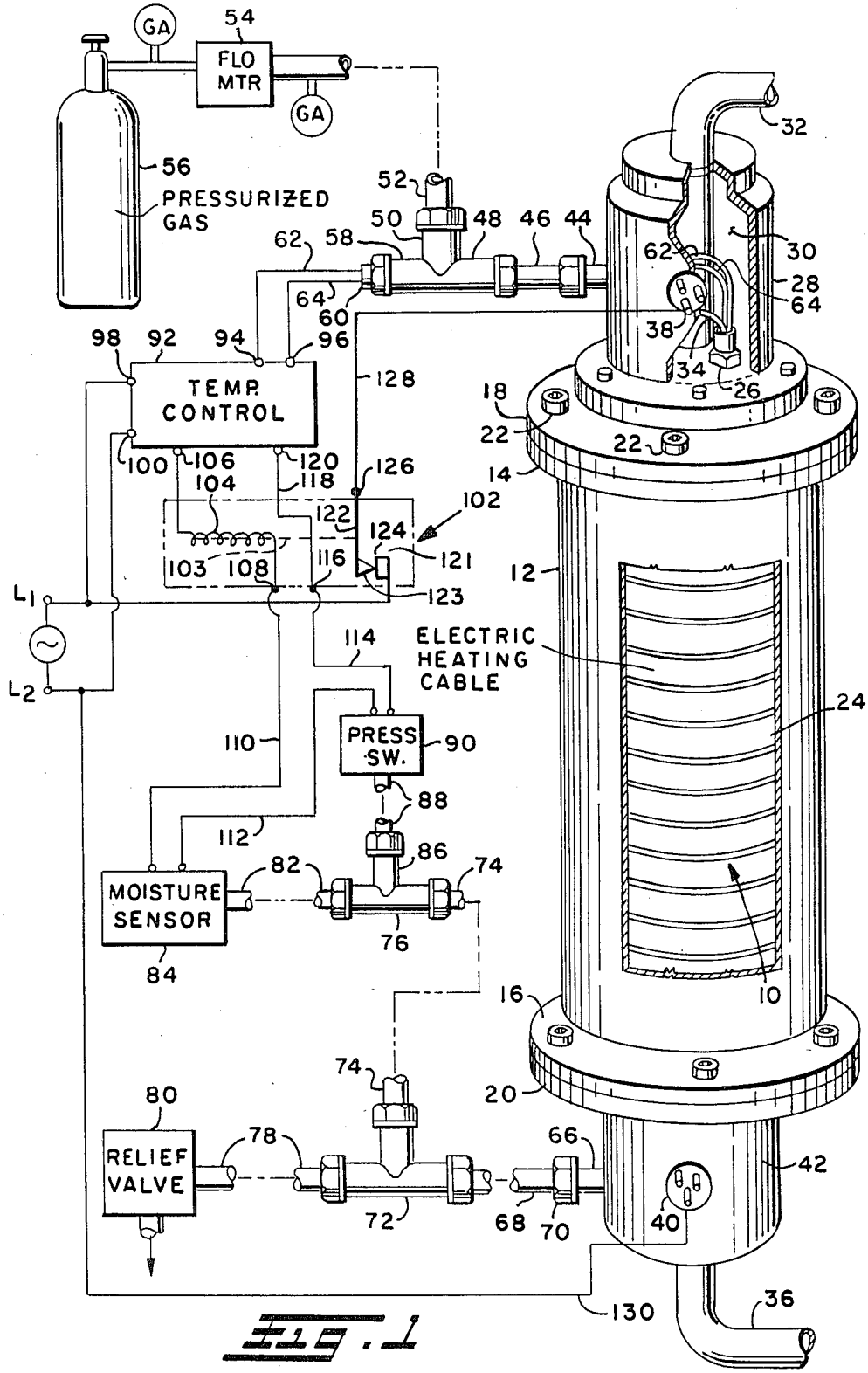
FIG. 1 is a schematic of a heater cable installation in a closed receptacle for heating a continuous pressurized flow of ionized water.

Referring now to FIG. 1, the flexible heater cable is shown installed generally at 10 in a closed receptacle or container 12 having flanges 14,16 and end plates 18,20 which may be secured to the flanges respectively by any suitable expedient such as bolts 22. The receptacle 12 has disposed therein a plurality of coils of a flexible heater cable 24 which has one end thereof received through the upper end plate in a suitable compression fitting 26, the lower end received through cap plate 20 in a similar manner. The shell or cover 28 provided over the upper end cap and the shell 28 is attached to and sealed about the face of end cap plate 15 providing thereabove a sealed chamber.

A suitable fluid or water conduit 32 is received through the upper shell 28 and passes therethrough to the interior chamber of the receptacle 12 for flow about the heater cable 24. A similar arrangement for an outlet pipe 36 is provided for permitting the fluid to exit the receptacle 12 at the opposite end thereof.

The power lead of the upper end of the heater cable is connected within chamber 30 to a suitable power connector pin 38 which stands through the wall of shell 28. The power cable lead in the heater cable jacket at the lower end of the receptacle 12 is similarly connected to a power cable pin 40 extending through the wall of lower shell 42.

A conduit connector 44 provided in the side of shell 28 and is connected by a conduit 46, preferably a flexible plastic tubing, to a suitable compression-type tee fitting 48.

One branch 50 of the tee is connected via conduit 52 to the outlet of a pressure regulator and flow meter 54 which is connected to receive a supply of pressurized dry gas medium from a reservoir or tank 56.

The remaining branch 58 of tee 48 which has a suitable rubber grommet 60 surrounded by a compression fitting on the end thereof with a pair of thermocouple leads 62, 64 extending outwardly therefrom which leads pass through the tee 48, fitting 44 and into the chamber 30 and through the interior of the cable jacket, as will be hereinafter described.

The lower shell 42 has a suitable gas purge fitting 66 provided in the sidewall thereof which has attached thereto a flexible tube 68 by suitable compression fitting 70. Tube 68 is connected to a tee 72 having one branch thereof connected via conduit 74 to a second tee 76. The other branch of tee 72 is connected via flexible tubing 78 to a suitable pressure relief valve 80. In the presently preferred practice of the invention the relief valve 80 is set to exhaust at pressure in the range of 3–5 psi gauge. In the presently preferred practice of the invention, the flow meter 54 is set to provide a flow of 2 cubic feet per hour of dry gas through tee 48. The flow is through tube 46, fitting 48, into the chamber 30 of shell 28 and into the interior of heater cable 24 and out through the lower end thereof to the chamber formed within the interior of lower shell 32. The gas in the interior of shell 42 is in communication with tube 68, tee 72, tee 76 and a relief valve 80.

Tee 76 has one branch thereof connected to a flexible tube 82 which is connected to a moisture sensor indicated at 84. Sensor 84 is operative to open a normally closed set of contacts disposed therein in response to detecting the presence of a preselected threshold level of moisture within tube 82.

A second branch 86 of tee 76 has connected thereto a flexible tubing 88 which communicates with the sensor cavity of a pressure switch 90. The pressure switch 90, in the preferred practice of the invention, is operative to open a normally closed set of contacts therein breaking a circuit, as will be hereinafter described. In the presently preferred practice of the invention, pressure switch 90 is set to go open circuit at pressure in the range 2–3 psi within lines 68, 74, 88, 72, 76 and shell 42.

Referring now to the left-hand portion of FIG. 1, temperature controller 92 is provided and has thermocouple lead 62, 64 connected thereto at terminals 94, 96 thereof. Temperature controller 92 is powered by connection through terminals 98, 100 respectively, to power line leads L1 and L2.

A relay, indicated generally at 102 and the dashed outline in FIG. 1, is provided and has an operating coil 104 and one end thereof connected to a signal output terminal 106 of the temperature controller. The other end of the coil connected to a terminal 108 which, in turn, is connected via lead 110 to one terminal of moisture sensor 84 with the remaining terminal of the moisture sensor connected in series via leads 112, 114 through pressure switch 90 and returned to relay terminal 116. Relay terminal 116 is connected via lead 118 to the remaining signal output terminal 120 of the temperature controller.

The armature 103 of coil 104 is operatively connected to a moveable arm 122 of a normally open switch 121 having a movable contact 123 for closing against stationary contact 124. Switch 121 is normally open and is closed by energization of relay coil 104. Stationary contact 124 is connected to power lead L1 and the moveable contact member 122 is connected via relay terminal 126 and lead 128 to power cable connecting pin 38 on the shell 28 of tank 12. The remaining cable power plug connector pin 40 on the lower heater shell 42 is connected to the opposite power lead L2 via lead 130.

In operation, in the embodiment of FIG. 1, liquid to be heated is circulated through conduit 32 and is disposed about the heater 10 and out conduit 36. The heater 10 is energized by the temperature controller 92 energizing relay coil 104 and closing switch 122 to connect the heater to power leads L1, L2. The heater 10 remains on until an overheat condition is sensed by a thermocouple (not shown in FIG. 1) disposed within heater cable 24 as will hereinafter be described with respect to the embodiments of FIGS. 2 and 3, which provides a signal to the controller through thermocouple lead 62, 64. Upon the controller 92 receiving an over temperature signal at terminals 94, 96 the controller is operative to de-energize relay coil 104 thereby causing switch 102 to go open circuit and shut off the heater 10.

Likewise, upon a low pressure condition being sensed by pressure switch 90, indicating low purge gas pressure in the system, and consequently the interior of heater cable 24, pressure switch 90 goes open circuit to energize relay coil 104. In similar fashion, a rupture or leak in the jacket of heater cable 24 permitting the liquid to be heated to enter the interior of the heater cable is sensed by moisture sensor 84 which thereupon causes an open circuit condition to lead 110, 112 to de-energize relay coil 104 and open the switch 102 for shutting down power to the heater.

In the presently preferred practice of the invention, the source of gaseous medium includes a pressure regulator to maintain pressure in the range of 5–7 psig through the flow meter and lines and into the chamber 30 for charging the interior of the heater through the open end of the cable jacket extending through fitting 26 into the chamber 30. In the present practice of the invention, it has been found particularly satisfactory to employ gases comprised in the majority of nitrogen, argon or helium. However, other suitable dry gaseous media may also be employed for continuous purging of the heater cable assembly.

Figure 2:
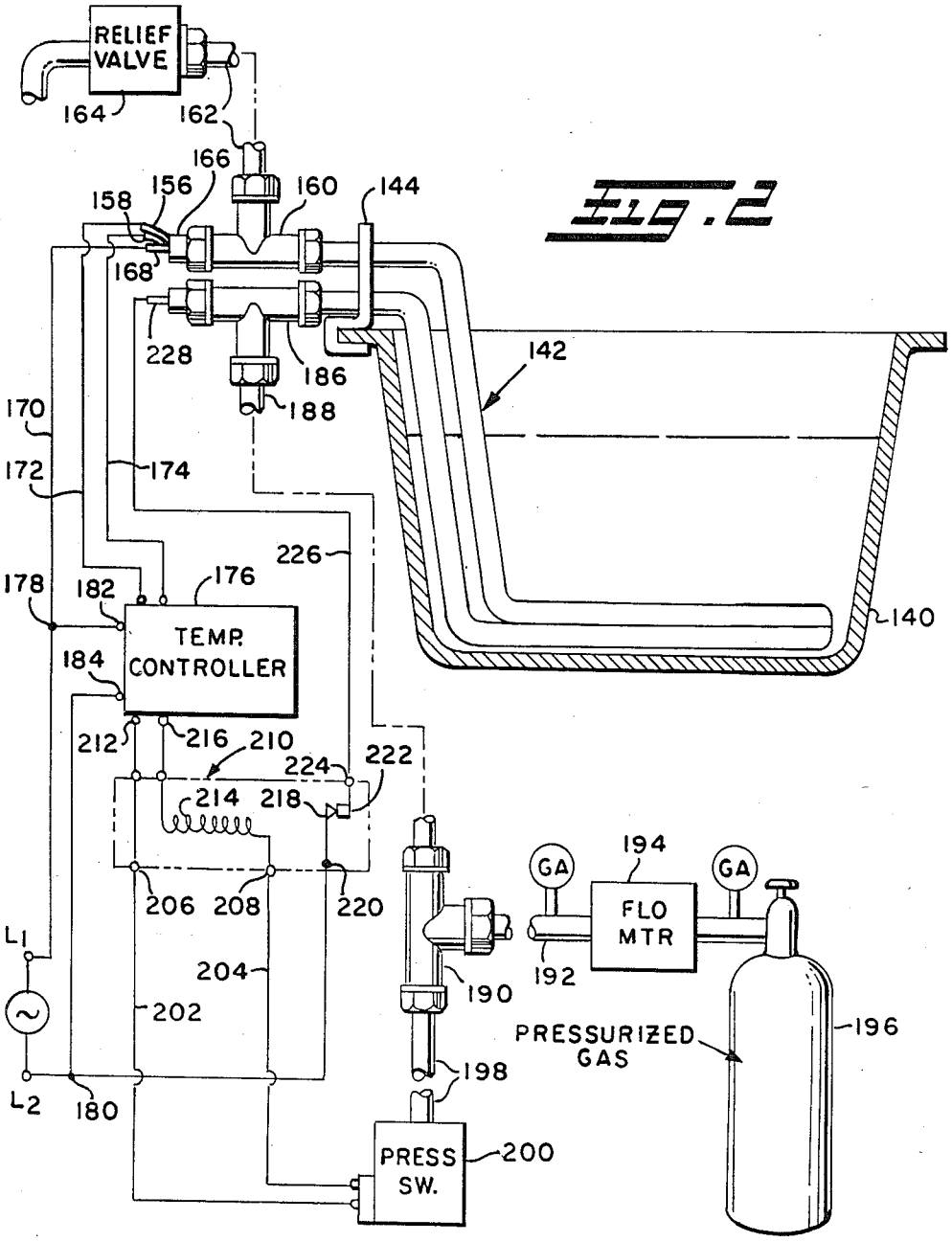
FIG. 2 is a schematic similar to FIG. 1 illustrating the invention as installed in a system for heating liquid in an open bath.
Figure 3:
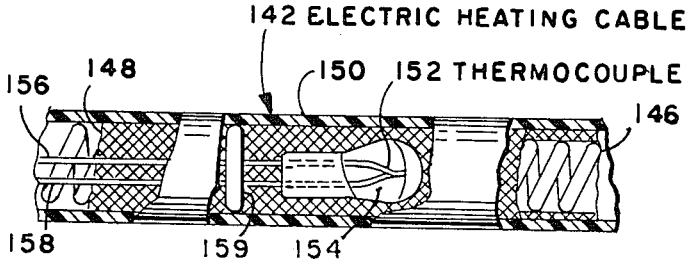
FIG. 3 is an enlarged view of a portion of the heater cable of the installation of FIG. 2.

Referring now to FIGS. 2 and 3, the invention is illustrated as embodied in a system employing an open liquid container 140 having a heater cable indicated generally at 142 immersed in liquid contained therein. The flexible heater cable 142 has the ends thereof extending out of the liquid bath and through a suitable mounting arrangement 144 provided on the rim of the receptacle 140.

Referring now to FIG. 3, a portion of the heater cable 142 is shown in enlarged view with portions thereof broken away for clarity. The heater cable 142 has an inner electrical conductor 146 formed of electrically resistive wire disposed in continuous axially spaced coiled pitches and having the braided sheath 148 formed of fibrous glass material received over the coiled element 146 in closely fitting sliding engagement. The sheathed conductor is encased with a jacket 150 in a continuous tubular configuration and received over the braided sheath in closely fitting free sliding engagement. The jacket 150 in the presently preferred practice is formed of a suitable thin wall plastic material as, for example, polytetrafluroethylene with PFA side chain and sold commercially under the trade name "Teflon® PFA" manufactured by E. I. DuPont de Nemoirs and Company, Wilmington, Del., U.S.A.

The heater cable 142 has provided therein a thermocouple for over temperature protection. With particular reference to FIG. 3, the thermocouple junction 152 is encased in a suitable cover 154 formed preferably of a thermosetting plastic material. The encasement is disposed between the braided sheath and the outer jacket 150 at a suitable location on the cable heater for early exposure to air upon loss of liquid in the container below a critical level which would permit overheating and melting of the jacket 150. The thermocouple has a pair of leads 156, 158 which extend longitudinally through the heater cable 142 and longitudinally outward of the jacket connected in a pressure tight connection to a tee 160. One branch of tee 160 is connected to a pressure fitting tubing 162 connected to the inlet of a pressure relief valve 164. The other branch of tee 160 is closed by a pressure tight fitting and resilient grommet 166 and has one power lead 168 of the heater cable extending therethrough and connected via lead 170 to one side L1 of a power line. The thermocouple leads 156, 158 also extend through grommet 166 and are connected via leads 172, 174 to the input terminals of a temperature controller 176. The controller is connected via junction 178 to one side of power line L1 and via junction 180 to the other side L2 of the power line through controller terminals 182, 184.

The opposite end of the heating cable 142 is connected to bracket 144 and has suitable pressure type fittings connected to a conduit tee 186 which has one branch thereof connected to a flexible tube 188 which is connected to a tee fitting 190. One branch of tee 190 is connected to a fluid conduit 192 to the outlet of meter 194 which receives a pressurized gaseous medium from reservoir 196. The remaining branch of tee 190 is connected to a fluid pressure fitting tube 198 which is connected to the sensing cavity of a pressure switch 200.

The gaseous fluid supply 196 is connected to provide a supply of purge gas through tee 190, tubing 188 and tee 186 through the cable heater 142 and, thus, through relief valve 164 to thereby provide a continuous gas purge to the interior of the cable heater 142.

The pressure switch 200 is connected electrically in series via leads 202, 204 to terminals 206, 208 of a relay indicated generally at 210 (dashed outline in FIG. 2). Terminal 206 of the relay is connected to one signal output terminal 212 of the temperature controller 176; and, terminal 208 is connected through relay coil 214 to terminal 216 of the temperature controller.

The relay coil 214 has an armature operably connected to a movable switch contact member 218 connected to junction 220. The stationary contact 222 of relay 210 is connected to terminal 224 and lead 226 to a heater power lead 228 out of tee 186.

In operation, the temperature controller 176 energizes the relay coil 214 and closes contacts 218, 222, and coil 214 is thereby energized. In the event that a break or leak in the heater cable jacket 150 occurs permitting loss of the gaseous medium, the decrease in the gas purge is sensed by pressure switch 200 which breaks the circuit in relay coil 214 thereby de-energizing the coil and opening switch contacts 218, 222 to turn off power to the heater cable 142. In the event that there is a loss of liquid in the container so the level drops below the surface of the heater cable causing an overheat condition, the increase in temperature of the heater cable jacket is sensed by the thermocouple 152 which causes controller 176 to de-energize relay coil 214 and break the power connection to the heater cable.

The present invention, thus, provides a unique flexible heater cable for immersion heating of liquid in a container. It employs a continuous gaseous purge of the flexible heater to remove hot chemical vapors which permeate the thin plastic heater cable jacket from the liquid being heated. The unique arrangement of the present immersion heater prevents accumulation of hot chemical vapors permeating the heater cable from corrosively attacking the resistive heating element and thereby causing heater failure. The heater cable of the present invention includes a uniquely arranged thermocouple for detecting heater over temperature rapidly in the event of overheating due to loss of liquid. The thermocouple arrangement enables immediate heater power shutdown to prevent destructive damage of the heater cable.

Although the invention has hereinabove been described in the presently preferred practice, it will be understood that the invention is capable of modification and variation and is limited only by the following claims.

It is now claimed:

1. The method of heating a highly corrosive liquid with an electrical immersion heater comprising:

(a) providing a continuous flexible cable heater having a coiled electrical resistance element with a flexible chemically resistant continuous tubular jacket disposed thereover and forming the exterior of said cable with said jacket; said jacket having a wall sufficiently thin to be subject to permeation by vapors of highly corrosive liquid;

(b) providing a source of dry gaseous medium and controlling the fluid pressure thereof;

(c) immersing said cable heater in a bath of highly corrosive liquid and subjecting said jacket to permeation of corrosive vapors from said bath through the wall of said jacket to said element;

(d) connecting said element to a source of electrical power and heating said element and effecting thermal conduction from said element through said jacket to said bath;

(e) isolating the ends of said tubular jacket from said liquid bath;

(f) continuously directing a flow of said dry gaseous medium into one end of said tubular jacket and flowing said medium within said jacket surrounding said element and exhausting said flow at the opposite end of said tubular jacket at a flow rate sufficient to purge said corrosive vapors.

2. An immersion heating apparatus for heating in highly corrosive liquid baths comprising:

(a) a flexible cable-type immersion heater for immersion in a corrosive bath, said heater having a wall sufficiently thin to be subject to permeation of the vapors of highly corrosive liquids; said heater including (i) a continuous coiled element of electrically resistive material disposed in axially closed spaced pitches and operative upon connection to a source of power to provide heat;

(ii) a continuous tubular outer jacket, said jacket formed of flexible plastic material received over said coiled element in closely fitting relationship and resistant to chemical attack by acidic and alkaline solutions, said tubular jacket having the wall thickness thereof sufficiently thin to provide heat transfer from said heater to the corrosive bath, said tubular jacket wall being sufficiently thin so as to be subjected to permeation of the corrosive vapors through said jacket to said coiled element;

(b) means operative to provide a source of dry gaseous medium under controlled fluid pressure;

(c) means isolating the ends of said tubular jacket from the corrosive liquid bath;

(d) means operative to direct a continuous flow of said dry gaseous medium into one end of said jacket and surrounding said coiled element to said opposite end at said controlled pressure for purging the corrosive vapors.

* * * * *